US007200974B2

(12) United States Patent
Higer et al.

(10) Patent No.: US 7,200,974 B2
(45) Date of Patent: Apr. 10, 2007

(54) LIDLESS VACUUM APPLIANCE

(75) Inventors: Landen Higer, Alameda, CA (US); Charles Wade Albritton, Hercules, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/909,971

(22) Filed: Jul. 30, 2004

(65) Prior Publication Data

US 2005/0028494 A1 Feb. 10, 2005

Related U.S. Application Data

(60) Provisional application No. 60/492,090, filed on Jul. 31, 2003, provisional application No. 60/492,035, filed on Jul. 31, 2003.

(51) Int. Cl.
*B65B 31/04* (2006.01)

(52) U.S. Cl. ..... 53/86; 53/512

(58) Field of Classification Search ..... 53/512, 53/79, 84, 85, 86, 374.8, 375.6, 434, 432, 53/510, 405

See application file for complete search history.

(56) References Cited

U.S. PATENT DOCUMENTS

| | | | | |
|---|---|---|---|---|
| 1,143,579 | A | | 6/1915 | Denhard |
| 2,079,069 | A | | 5/1937 | Johnson |
| 2,319,011 | A | | 5/1943 | Meredith |
| 2,354,423 | A | | 7/1944 | Rosenberger |
| 2,421,149 | A | | 5/1947 | Hard et al. |
| 2,568,226 | A | | 9/1951 | Drake |
| 2,617,304 | A | | 11/1952 | Conover |
| 2,749,686 | A | | 6/1956 | Lorenz et al. |
| 2,778,171 | A | | 1/1957 | Taunton |
| 2,838,894 | A | * | 6/1958 | Paikens et al. ..... 53/79 |
| 2,899,786 | A | | 8/1959 | Harker |
| 3,038,283 | A | | 6/1962 | Unger |
| 3,148,269 | A | | 9/1964 | Van Hartesveldt et al. |
| 3,464,256 | A | | 9/1969 | Lloyd |
| 3,516,223 | A | | 6/1970 | Andersen et al. |
| 3,688,463 | A | | 9/1972 | Titchenal |
| 3,699,742 | A | | 10/1972 | Giraudi |
| 3,788,651 | A | * | 1/1974 | Brown et al. ..... 277/646 |
| 3,928,938 | A | | 12/1975 | Burrell |
| 3,962,847 | A | | 6/1976 | Trudel |
| 3,965,646 | A | | 6/1976 | Hawkins |
| 4,006,329 | A | | 2/1977 | Hellman et al. |
| 4,008,601 | A | | 2/1977 | Woods |
| 4,105,491 | A | | 8/1978 | Haase et al. |
| 4,106,661 | A | * | 8/1978 | Hunt ..... 220/232 |
| 4,164,111 | A | | 8/1979 | Di Bernardo |
| 4,208,902 | A | | 6/1980 | Kim et al. |

(Continued)

FOREIGN PATENT DOCUMENTS

EP 0723915 A1 7/1996

(Continued)

*Primary Examiner*—Stephen F. Gerrity
*Assistant Examiner*—Paul Durand
(74) *Attorney, Agent, or Firm*—Lawrence J. Shurupoff

(57) ABSTRACT

A lidless vacuum packaging appliance whereby the number of movable parts is reduced is disclosed. A lidless appliance effectively reduces wear and tear of the appliance. Further, the lidless design allows for convenient placement in the operational environment of the appliance.

4 Claims, 7 Drawing Sheets

U.S. PATENT DOCUMENTS

| | | | | |
|---|---|---|---|---|
| 4,330,975 | A | 5/1982 | Kakiuchi | |
| 4,371,175 | A * | 2/1983 | Van Dyk, Jr. | 174/35 GC |
| 4,372,096 | A | 2/1983 | Baum | |
| 4,541,224 | A | 9/1985 | Mugnai | |
| 4,545,177 | A | 10/1985 | Day | |
| 4,549,387 | A | 10/1985 | Marshall et al. | |
| 4,561,925 | A | 12/1985 | Skerjanec et al. | |
| 4,578,928 | A | 4/1986 | Andre et al. | |
| 4,581,764 | A | 4/1986 | Plock et al. | |
| 4,631,512 | A | 12/1986 | Hishiki et al. | |
| 4,641,482 | A | 2/1987 | Metz | |
| 4,928,829 | A | 5/1990 | Di Bernardo | |
| 4,941,310 | A | 7/1990 | Kristen | |
| 5,012,615 | A * | 5/1991 | Piccinini et al. | 49/477.1 |
| 5,048,269 | A | 9/1991 | Deni | |
| 5,352,323 | A | 10/1994 | Chi | |
| 5,461,901 | A | 10/1995 | Ottestad | |
| 5,608,167 | A | 3/1997 | Hale et al. | |
| 5,638,664 | A * | 6/1997 | Levsen et al. | 53/512 |
| 5,682,727 | A * | 11/1997 | Harte et al. | 53/434 |
| D389,847 | S | 1/1998 | Huang | |
| 5,712,553 | A | 1/1998 | Hallberg | |
| 5,765,608 | A | 6/1998 | Kristen | |
| 5,784,862 | A | 7/1998 | Germano | |
| 5,825,974 | A | 10/1998 | Hutton | |
| 5,893,822 | A | 4/1999 | Deni | |
| 6,058,998 | A | 5/2000 | Kristen | |
| 6,124,558 | A | 9/2000 | Baumeister et al. | |
| 6,256,968 | B1 * | 7/2001 | Kristen | 53/512 |
| 6,328,897 | B1 | 12/2001 | Leung | |
| 6,467,242 | B1 * | 10/2002 | Huang | 53/512 |
| 6,520,071 | B1 | 2/2003 | Lanza | |
| 6,694,710 | B2 | 2/2004 | Wang | |
| 6,827,243 | B1 * | 12/2004 | Nuzzolese | 222/628 |
| 2003/0140603 | A1 * | 7/2003 | Krasenics et al. | 53/434 |
| 2004/0065051 | A1 * | 4/2004 | Patterson et al. | 53/432 |

FOREIGN PATENT DOCUMENTS

| | | |
|---|---|---|
| EP | 1053945 A1 | 11/2000 |
| JP | 05-10211 | 2/1993 |
| JP | 2000-43818 | 2/2000 |
| WO | WO00/71422 | 11/2000 |

* cited by examiner

LIDLESS VACUUM APPLIANCE

This application claims priority to U.S. Provisional Patent Application No. 60/492,090, entitled, "Vacuum Sealing Device With Integrated Sealing Elements And Evacuation Chamber" by Landen Higer and Charles Wade Albritton, filed on Jul. 31, 2003, and which is hereby incorporated by reference in its entirety. This application further claims priority to U.S. Provisional Patent Application No. 60/492,035, entitled, "Decoupled Vacuum Packaging Machine" by Landen Higer et al., filed on Jul. 31, 2003, and which is hereby incorporated by reference in its entirety.

FIELD OF THE INVENTION

The present invention generally relates to vacuum packaging appliances. More particularly, the invention is directed to a lidless vacuum packaging appliance that can be conveniently stored.

BACKGROUND

Vacuum packaging is a process for removing oxygen and other gases from containers holding food and other products that deteriorate in the presence gases. For example, food spoilage can occur due to oxidation. Thus, vacuum packaging can extend the life of products that deteriorate in the presence of gases by removing nearly all of the gases in a sealed container in which such products are stored.

While vacuum packaging appliances are very useful, as with most appliances, appliance components suffer from wear and tear. For example, those movable components that are frequently handled are prone to fall into disrepair. Further, such appliances can be unwieldy and occupy a good deal of valuable counter space and/or storage space. Thus, there is a need for vacuum packaging appliances that are configured for reduced wear and tear and for convenient storage.

BRIEF DESCRIPTION OF THE DRAWINGS

The present invention is illustrated by way of example, and not by way of limitation.

DETAILED DESCRIPTION OF THE PREFERRED EMBODIMENT

A lidless vacuum packaging appliance is described. In the following description, for purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

According to certain embodiments a vacuum appliance is designed to be lidless in order to reduce the number of movable parts and thus effectively reduce wear and tear of the appliance. Further, the lidless design described herein allows for convenient placement in the operational environment of the appliance. For example, a lidless vacuum appliance can be affixed under a counter or cabinet so as to save counter-top space as well as allow for convenient access during operational mode. When such an appliance is not is use, there is no need to find storage space for the appliance since the appliance is affixed in a location that is largely non-intrusive.

Figure 1:
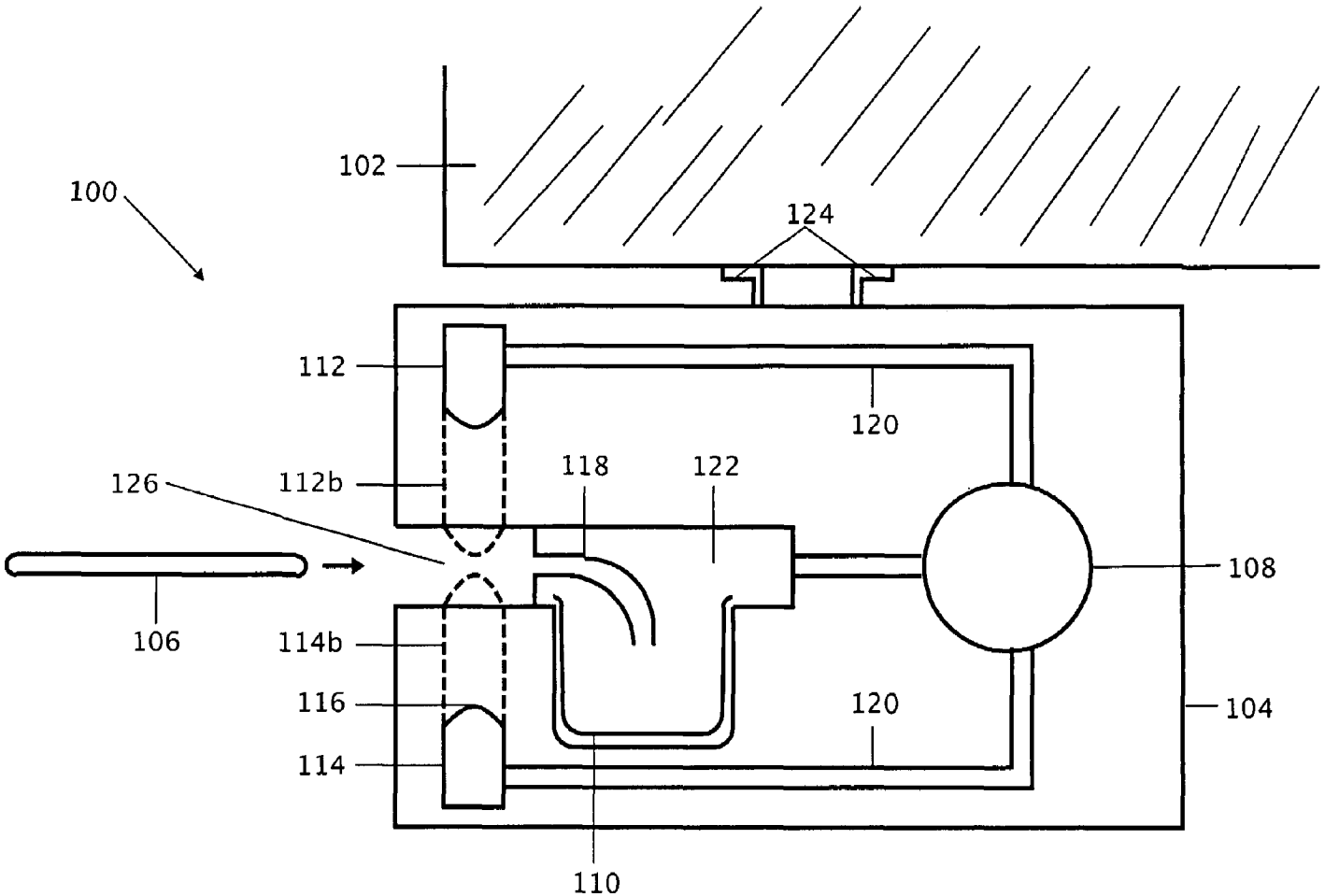
FIG. 1 is a cross sectional view of a lidless vacuum appliance, according to certain embodiments.

FIG. 1 is a cross sectional view of a lidless vacuum appliance, according to certain embodiments. View 100 shows a side view of cabinet or counter 102 and lidless vacuum appliance 104 and packaging bag 106. Lidless vacuum appliance 104 is affixed under the counter 102 by brackets 124. Lidless vacuum appliance 104 can be adapted for affixing to any supporting structure and thus may vary from implementation to implementation. For example, lidless vacuum appliance 104 can be affixed to a wall, an over-hang, or a boom that is either movable or fixed. FIG. 1 shows the lidless vacuum appliance 104 including a slot 126, a guide track 118, a drip tray 110, a vacuum chamber 122, a sealing element 116, bladders 112 and 114, and motor components 108. Bladders 112 and 114 are operationally connected to motor components 108 by connectivity components 120. Examples of connectivity components 120 are pipes or hoses. The lidless vacuum appliance also include the attendant circuitry and other components (not shown) for operating the vacuum and sealing processes.

In order to vacuum seal packaging bag 106, packaging bag 106 is inserted in slot 126 of lidless vacuum appliance. Guide track 118 guides the mouth of packaging bag 106 into drip tray 110. Drip tray 110 is for catching any fluids or other particles that might fall out of the bag during the vacuum packaging process. Before the vacuum packaging process begins, bladders 112 and 114 each inflate in order to clamp onto packaging bag 106 to form an air-tight seal such that air does not flow through slot 126 past the bladders into the vacuum chamber. Bladders 112 and 114 are inflated by an intake of air through connectivity components 120 caused by operation of motor components 108. Phantom bladders 112*b* and 114*b* show the inflated position of bladders 112 and 114. When an airtight seal is formed, the vacuum packaging process can begin by evacuating gasses from the vacuum chamber and from the interior of packaging bag 106. When packaging bag 106 is sufficiently evacuated of gases, heating element 116 can be activated for forming a heat seal on packaging bag 106. Such a heat seal prevents air from re-entering the bag. After packaging bag 106 is heat sealed, bladders 112 and 114 can be deflated to allow packaging bag 106 to be extricated from the lidless vacuuming appliance 104.

Figure 2:
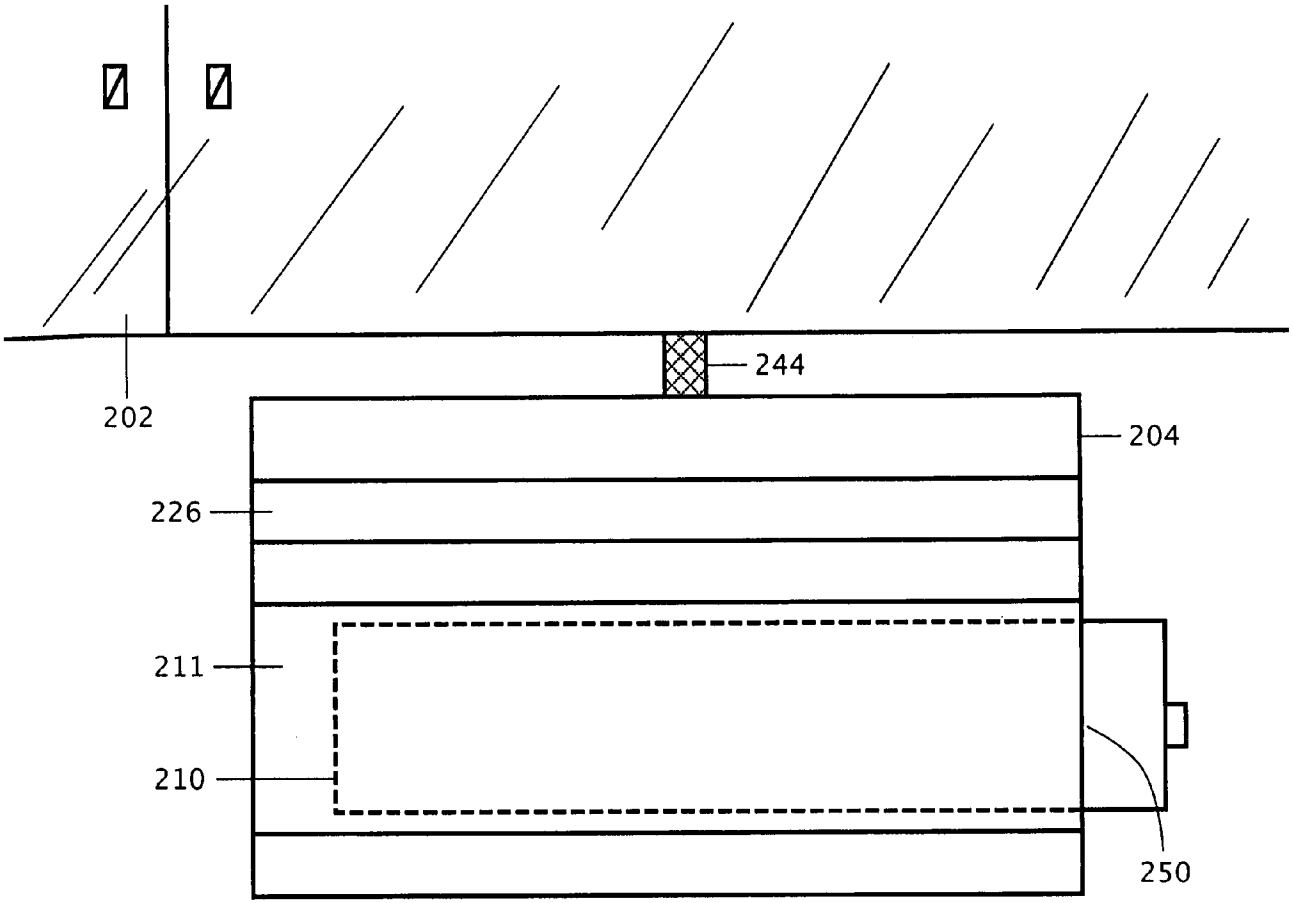
FIG. 2 is a frontal view of lidless vacuum appliance, according to certain other embodiments.

According to certain embodiments, drip tray 110 can be detached from the lidless vacuuming appliance 104 conveniently through an opening on the side of the appliance as described herein with reference to FIG. 2. FIG. 2 is a frontal view of lidless vacuum appliance, according to certain other embodiments. In FIG. 2, a lidless vacuuming appliance 204 is affixed under a cabinet or counter 202 by one or more screws 244. FIG. 2 shows slot 226 through which a packaging bag can be inserted for evacuating a gases from the packaging bag. FIG. 2 also shows a cavity 211 where drip tray 210 resides in lidless vacuum appliance 204. Drip tray 210 can be extricated from lidless vacuum appliance 204 by sliding drip tray 210 out from lidless vacuum appliance 204 through opening 250. Opening 250 is airtight sealed when drip tray 210 is completely inserted into cavity 211.

Figure 3:
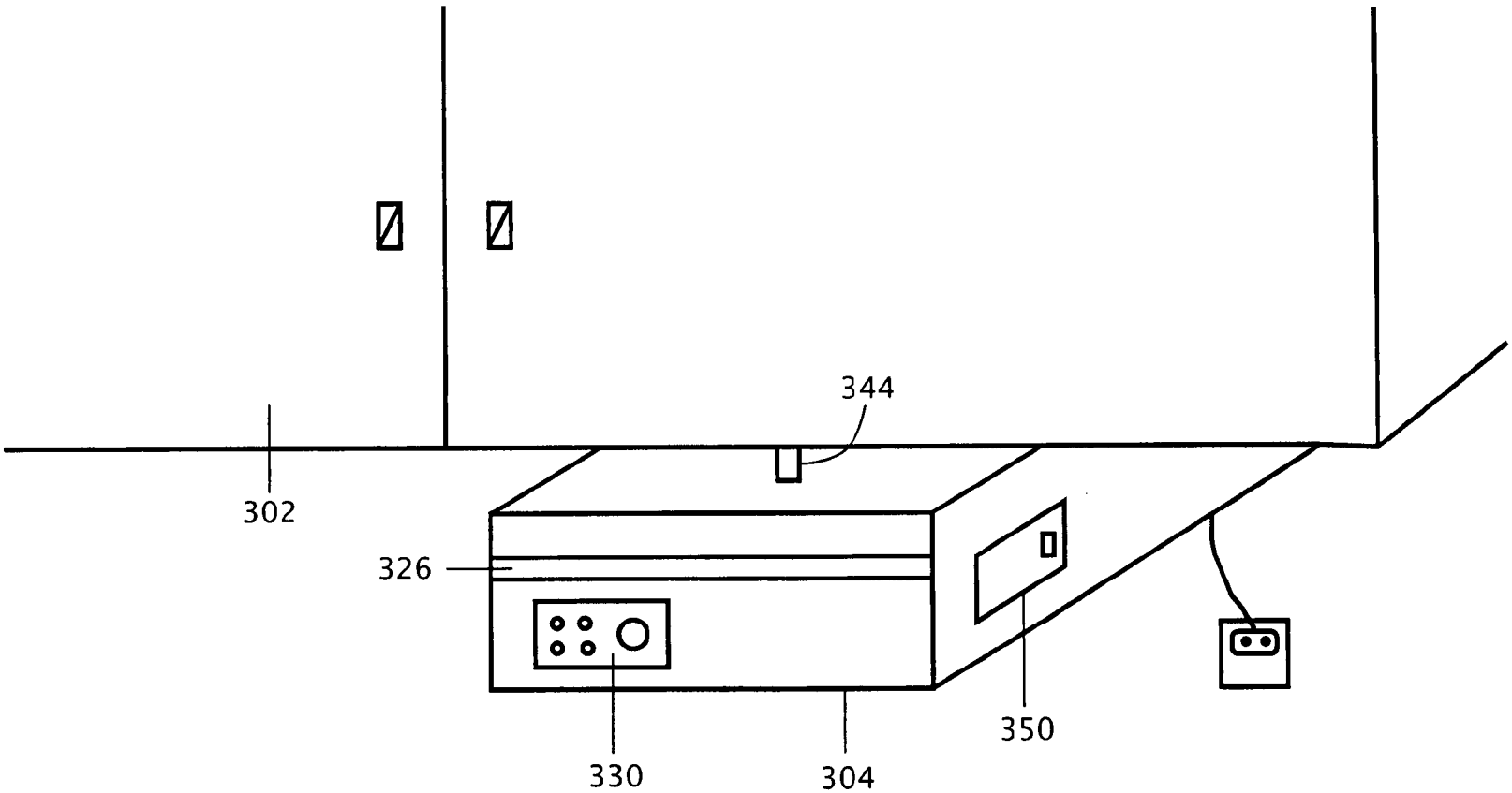
FIG. 3 is a partial perspective view of a lidless vacuum appliance that illustrates space-saving placement of the appliance.

FIG. 3 is a partial perspective view of a lidless vacuum appliance 304 that illustrates space-saving placement of the appliance. FIG. 3 shows that lidless vacuum appliance 304 is affixed under a cabinet or counter by attachment 344. FIG. 3 also shows that lidless vacuum appliance 304 includes a slot 326, a control panel 330, and a side opening 350 (egress) through which the drip tray in the appliance can be extricated. According to certain embodiments, the lidless vacuum appliance 304 can include a pair of openings, one on either side of the appliance 304, either one of which can be used for extricating the drip tray.

Figure 4:
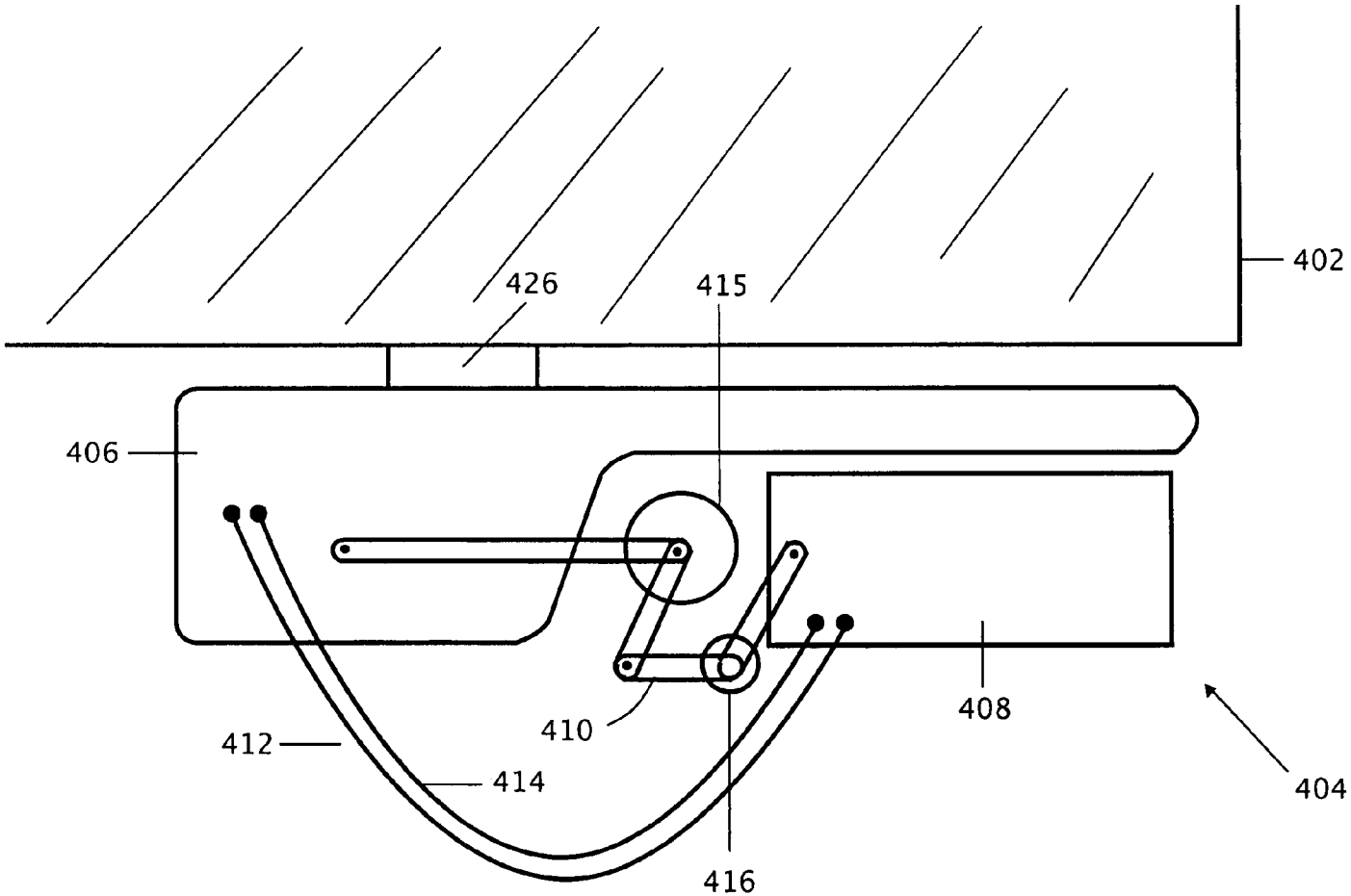
FIG. 4 is a side view of an under-cabinet or under-counter vacuum appliance in retracted storage mode.

FIG. 4 is a side view of an under-cabinet or under-counter vacuum appliance in retracted storage mode. In FIG. 4, lidless vacuum appliance 404 us affixed under cabinet 402 by an attachment 426. In FIG. 4, lidless vacuum appliance 404 is shown in a retracted storage mode as described herein. Lidless vacuum appliance 404 includes a fixed component 406 and a movable component 408, extension rods 410, electrical connection 414 and vacuum hose 412. Lidless vacuum appliance 404 can optionally include bag-roll 412 and bag-cutter 416. Fixed component 406 houses a vacuum motor (not shown) connected to a vacuum chamber (not shown) in movable component 408 via vacuum hose 412. Movable component 408 also houses a drip tray used for sealing a packaging bag. Vacuum hose 412 can also be used to inflate bladders in movable component 408 for sealing the vacuum chamber during an evacuation process. In FIG. 4, extension rods 410 are folded into a retracted position such that movable component 408 remains tucked under counter 402 and is in close proximity to fixed component 406.

Figure 5:
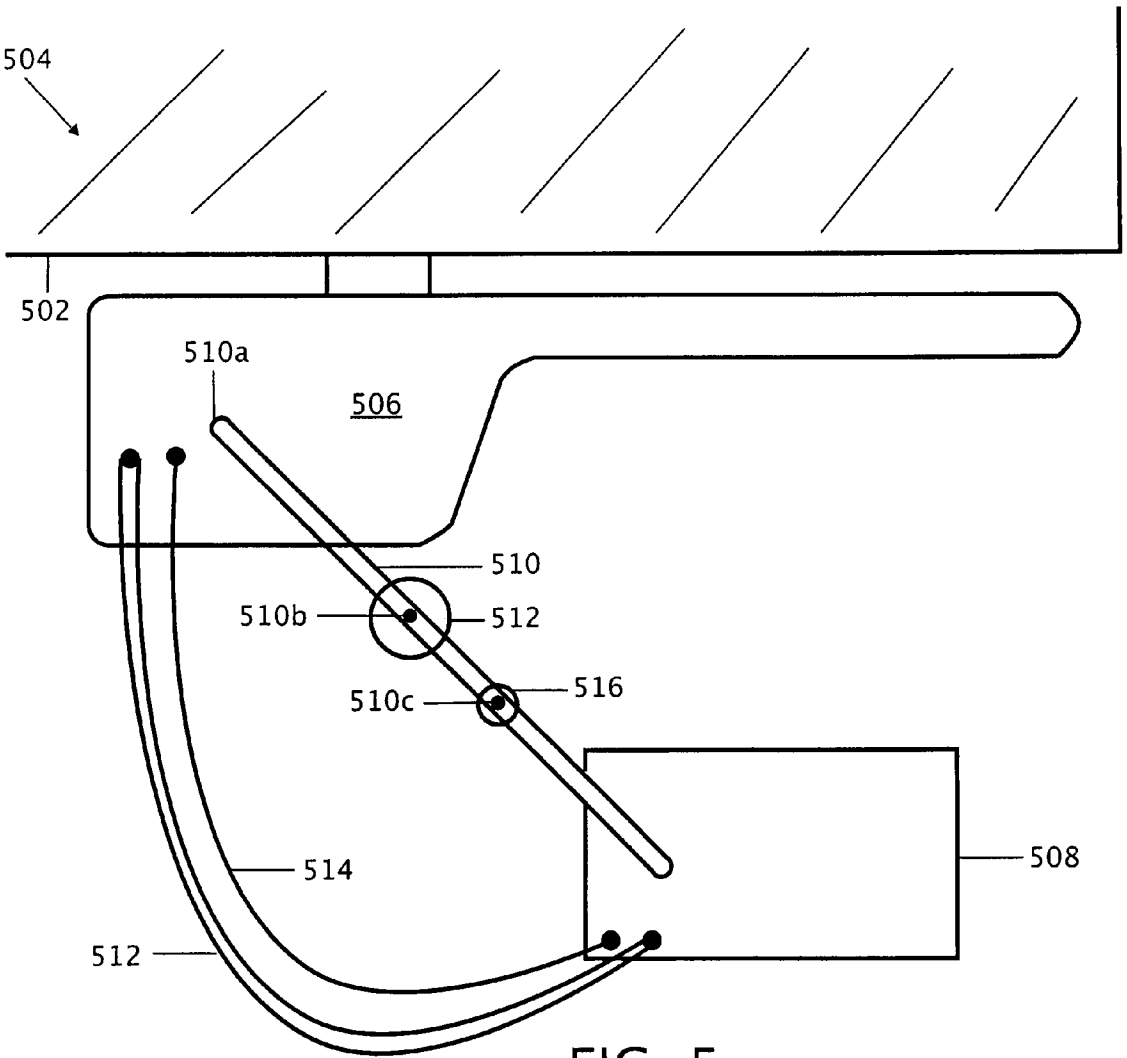
FIG. 5 is a side view of an under-cabinet or under-counter vacuum appliance in an extended configuration for operation.

FIG. 5 is a side view of an under-cabinet or under-counter vacuum appliance in an extended configuration for operation. In FIG. 5, movable component 508 of lidless vacuum appliance 504 is extended away from fixed component 506 of lidless vacuum appliance 504. Such an extension is made possible by unfolding extension rods 510. Extension rods 510 can also be pivoted about joints 510*a*, 510*b* and 510*c* in order to situate movable component 508 in a suitable position for operation. In the extended position, movable component 508 is conveniently located for ease of use. FIG. 5 also shows bag-roll 512, bag-cutter 516, electrical connection 514 and vacuum hose 512.

Figure 6B:
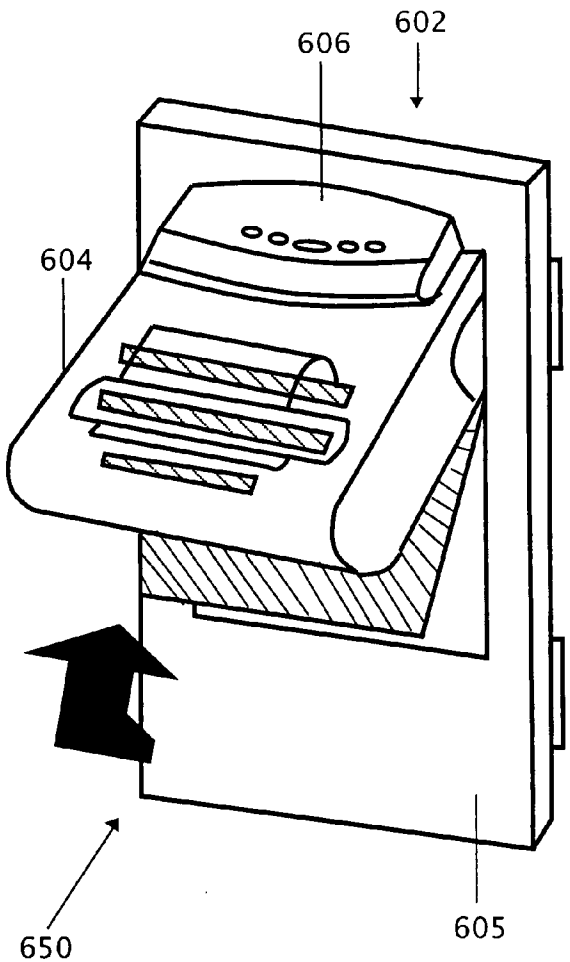
FIG. 6B is a perspective view of a vacuum appliance in operation mode for a wall or cabinet.
Figure 6A:
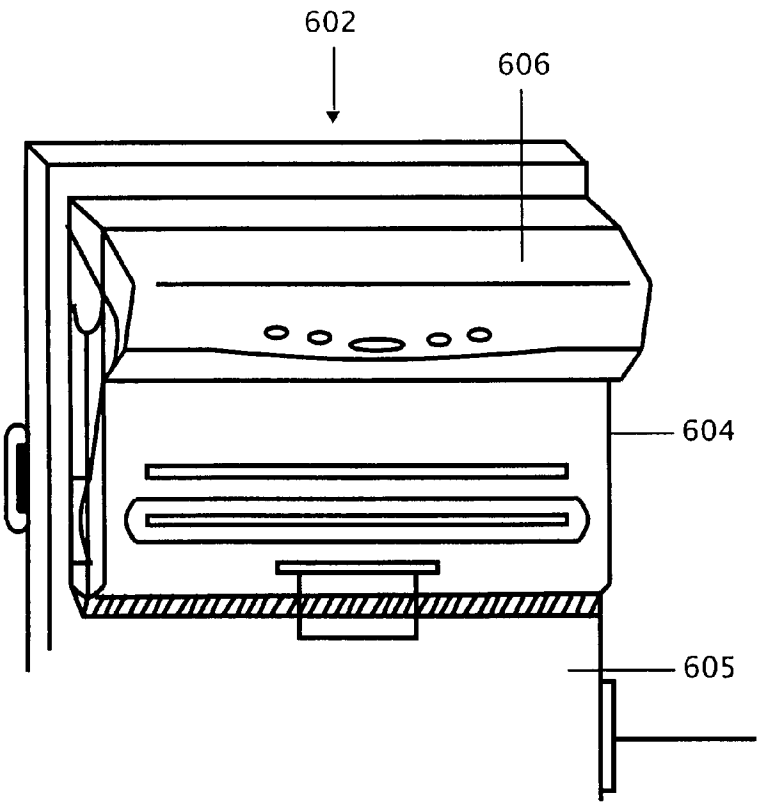
FIG. 6A is a perspective view of a vacuum appliance in storage mode for a wall or cabinet.

FIGS. 6A and 6B illustrate a frontal isometric view of a vacuum appliance for a wall or cabinet. FIGS. 6A and 6B show a vacuum appliance 602 affixed to a cabinet door or to a wall 605. Vacuum appliance 602 includes a movable receptacle component 604 and a fixed component 606. Receptacle component 604 may be pivoted up away from wall 605, i.e., flipped-up, about a pivot axis that runs the length of fixed component 606. Movable receptacle component 604 is flipped up when in operating mode as shown in FIG. 6B. FIG. 6A shows vacuum appliance 602 in storage mode. In this configuration, movable receptacle component 604 may be pivoted down against wall 605. In other words, vacuum appliance 602 is flipped-down for convenient storage (idle storage mode). Vacuum appliance 602 can be a lidless vacuum appliance.

Figure 7B:
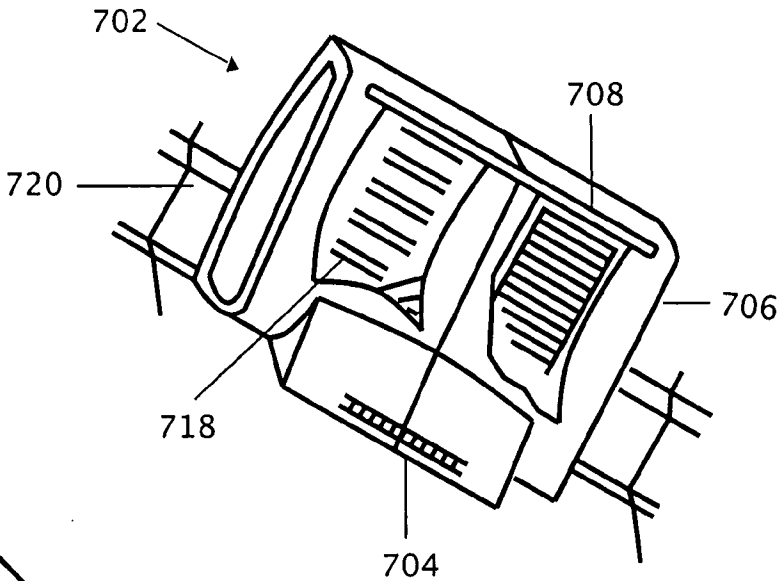
FIG. 7B is a perspective view a vacuum appliance in storage mode.
Figure 7A:
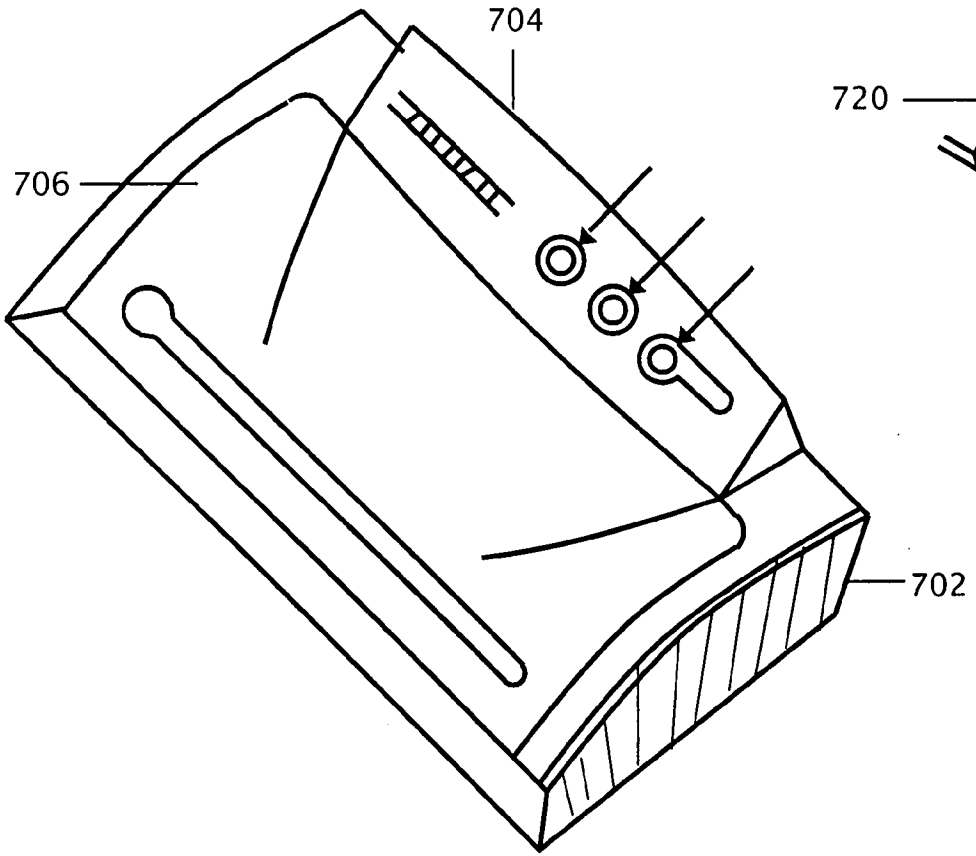
FIG. 7A is a perspective view a vacuum appliance in operation mode.

FIG. 7A is a perspective view of a vacuum packaging apparatus 702 that is configurable either for storage mode or operation mode. Vacuum packaging apparatus 702 includes a base 704 and a pivotable receptacle 706. Pivotable receptacle 706 can be pivoted about base 704 and receives the packaging bag that is to be evacuated of gases when evacuation is desired. FIG. 7A shows vacuum packaging apparatus 702 in operation mode (ready for container evacuation and sealing operation).

FIG. 7B is a perspective view a vacuum packaging apparatus 702 in operation mode. FIG. 7B illustrates the pivoting vacuum packaging apparatus of FIG. 7A in a pivoted configuration for convenient storage. In FIG. 7B, stationary base 704 of the vacuum packaging apparatus 702 may optionally be affixed to a wall or countertop back-splash 720. Movable receptacle component 706 may be pivoted up ("flipped-up") towards the wall, about a pivot axis that runs the length of stationary base 704. Movable receptacle component 706 may optionally include an x-ray style strip 708 for holding notes and recipes 718. X-ray style strip 708 doubles as a foot when movable receptacle component 706 lies flat on the countertop surface during operation mode. The pivoted configuration as shown in FIG. 7B saves countertop space. Optionally, vacuum packaging apparatus 702 may include a mechanism that prevents operation of the vacuum packaging apparatus when the vacuum packaging apparatus is in the flipped-up position.

In the foregoing specification, embodiments of the invention have been described with reference to numerous specific details that may vary from implementation to implementation. The specification and drawings are, accordingly, to be regarded in an illustrative rather than a restrictive sense.

What is claimed is:

1. A lidless vacuum packaging appliance, said lidless vacuum packaging appliance comprising:

a receiving slot for receiving a vacuum packaging bag;

a vacuum chamber;

a recessed removable drip tray;

a guide track for guiding said vacuum packaging bag into said recessed removable drip tray; and further comprising inflatable bladders for vacuum sealing said vacuum chamber wherein said inflatable bladders are inflated before evacuation of said vacuum packaging bag.

2. A lidless vacuum packaging appliance, said lidless vacuum packaging appliance comprising:

a receiving slot for receiving a vacuum packaging bag;

a vacuum chamber;

a recessed removable drip tray;

a guide track for guiding said vacuum packaging bag into said recessed removable drip tray; and further comprising inflatable bladders for vacuum sealing said vacuum chamber wherein said inflatable bladders are inflated for heat sealing said vacuum packaging bag.

3. A lidless vacuum packaging appliance, said lidless vacuum packaging appliance comprising:

a receiving slot for receiving a vacuum packaging bag;

a vacuum chamber;

a recessed removable drip tray;

a guide track for guiding said vacuum packaging bag into said recessed removable drip tray;

a heat sealing element for sealing said vacuum packaging bag; and further comprising inflatable bladders for vacuum sealing said vacuum chamber wherein said heat sealing element is integrated with at least one of said inflatable bladders.

4. A lidless vacuum packaging appliance, said lidless vacuum packaging appliance comprising:

a receiving slot for receiving a vacuum packaging bag;

a vacuum chamber;

a recessed removable drip tray;

a guide track for guiding said vacuum packaging bag into said recessed removable drip tray; and further comprising inflatable bladders for vacuum sealing said vacuum chamber wherein said inflatable bladders are deflatable to allow for removal of said vacuum packaging bag.

* * * * *